US010415347B2

(12) United States Patent
Reid

(10) Patent No.: US 10,415,347 B2
(45) Date of Patent: Sep. 17, 2019

(54) DOWNHOLE TOOL HAVING AN AXIALLY ROTATABLE VALVE MEMBER

(71) Applicant: Halliburton Energy Services, Inc., Houston, TX (US)

(72) Inventor: Michael Adam Reid, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 176 days.

(21) Appl. No.: 15/528,495

(22) PCT Filed: Sep. 29, 2016

(86) PCT No.: PCT/US2016/054325

§ 371 (c)(1),
(2) Date: May 19, 2017

(87) PCT Pub. No.: WO2018/063211

PCT Pub. Date: Apr. 5, 2018

(65) Prior Publication Data

US 2019/0085658 A1 Mar. 21, 2019

(51) Int. Cl.
*E21B 34/06* (2006.01)
*E21B 23/00* (2006.01)
(Continued)

(52) U.S. Cl.
CPC ..... *E21B 34/06* (2013.01); *E21B 23/00* (2013.01); *E21B 34/16* (2013.01); *E21B 47/06* (2013.01); *E21B 2034/002* (2013.01)

(58) Field of Classification Search
CPC ..... E21B 43/123; E21B 2034/002
See application file for complete search history.

(56) References Cited

U.S. PATENT DOCUMENTS 2,803,197 A * 8/1957 Wiley ..... E21B 34/066 137/606
2,876,703 A * 3/1959 Carlisle ..... E21B 43/122 137/155

(Continued)

FOREIGN PATENT DOCUMENTS

| | | |
|---|---|---|
| GB | 2250320 | 12/1994 |
| GB | 2457825 B | 4/2010 |
| WO | 2016032504 | 3/2016 |

OTHER PUBLICATIONS

International Search Report and Written Opinion for PCT/US2016/054325, dated May 10, 2017.

(Continued)

*Primary Examiner* — Shane Bomar
(74) *Attorney, Agent, or Firm* — Benjamin Fite; C. Tumey Law Group PLLC

(57) ABSTRACT

Downhole tools and methods and systems related thereto, wherein the downhole tool comprises a body having a body inner flow bore, a port in the body, a valve member axially rotatable relative to the body between an open position and a closed position, and an actuable drive shaft of a gearbox and a motor connected to the valve member to axially rotate the valve member. The open position allows fluid communication between the port and the body inner flow bore and the closed position prevents fluid communication between the port and the body inner flow bore, and the gearbox and the motor are in the body and axially offset from the body inner flow bore.

20 Claims, 10 Drawing Sheets

(51) Int. Cl.

| | |
|---|---|
| ***E21B 34/16*** | (2006.01) |
| ***E21B 47/06*** | (2012.01) |
| *E21B 34/00* | (2006.01) |

(56) References Cited

U.S. PATENT DOCUMENTS

| | | | | | |
|---|---|---|---|---|---|
| 3,665,955 | A | | 5/1972 | Conner, Sr. | |
| 4,058,165 | A | | 11/1977 | Holden et al. | |
| 4,373,582 | A | | 2/1983 | Bednar et al. | |
| 5,172,717 | A | * | 12/1992 | Boyle | E21B 34/06 137/155 |
| 5,318,127 | A | | 6/1994 | Hines et al. | |
| 6,148,843 | A | * | 11/2000 | Pringle | E21B 34/066 137/155 |
| 6,758,277 | B2 | * | 7/2004 | Vinegar | E21B 17/003 166/250.03 |
| 8,191,629 | B2 | | 6/2012 | Gordon et al. | |
| 8,316,593 | B2 | | 11/2012 | Smith et al. | |
| 8,522,886 | B2 | | 9/2013 | Christie et al. | |
| 9,133,682 | B2 | * | 9/2015 | Tahoun | E21B 34/06 |
| 2002/0108747 | A1 | | 8/2002 | Dietz et al. | |
| 2010/0071896 | A1 | | 3/2010 | Christie et al. | |
| 2011/0036562 | A1 | | 2/2011 | Braekke | |
| 2011/0088912 | A1 | | 4/2011 | Reid | |
| 2013/0269951 | A1 | * | 10/2013 | Tahoun | E21B 34/06 166/373 |
| 2014/0034299 | A1 | | 2/2014 | Christie et al. | |
| 2014/0151066 | A1 | | 6/2014 | Reid | |

OTHER PUBLICATIONS

Supplementary European Search Report for Application No. EP 16 91 7919, dated May 29, 2019.

* cited by examiner

DOWNHOLE TOOL HAVING AN AXIALLY ROTATABLE VALVE MEMBER

BACKGROUND

The present disclosure relates to subterranean formation operations and, more particularly, to a downhole tool having an axially rotatable valve member.

Hydrocarbon producing wells (e.g., oil producing wells, gas producing wells, and the like) are created and stimulated using treatment fluids introduced into the wells to perform a number of subterranean formation operations. For example, various servicing operations may be carried out to ensure that the efficiency and integrity of the wells are maximized and maintained, such as work overs, surface wellhead tree changes, side tracking, close proximity drilling operations, and the like. To perform such operations, downhole tools comprising one or more valve member (e.g., a circulation valve) may be used to form a seal or open the outside of a tubing string (e.g., a production tubing string, a drilling tubing string, and the like) to an annulus formed between the exterior of a tubing string and a casing string or a wellbore surface (e.g., in open hole applications). Such a valve member may allow verification pressure tests to be performed, isolate production zones, treat portions of a formation (e.g., with lost circulation material), and the like.

Such valve members are typically run into or retrieved from a wellbore on wireline or slickline, for example, into a tubing string or as an integral component of the tubing string. Typical valve members are configured to open or close based on pressure equalization, such that the valve member allows fluid communication between the interior of the tubing string and the annulus. The opening of the valve member is generally in response to an applied and maintained pressure within a predetermined pressure range for a particular period of time. Accordingly, the operation of such traditional valve members operates based on the principle of applied differential pressures, requiring knowledge of the pressure of the wellbore. That is, the pressure applied at surface must correspond to the pressure suitable for actuating the valve member to open (and close), which requires applied pressure adjustment to account for any variations in ambient well pressure. Further, gradual changes (e.g., increases) in wellbore pressure, such as due to environmental conditions, may lead to unintentional pressure variations affecting the actuation of the valve member.

BRIEF DESCRIPTION OF THE DRAWINGS

The following figures are included to illustrate certain aspects of the present disclosure and should not be viewed as exclusive examples. The subject matter disclosed is capable of considerable modifications, alterations, combinations, and equivalents in form and function, as will occur to one having ordinary skill in the art and the benefit of this disclosure.

DETAILED DESCRIPTION

Figure 1:
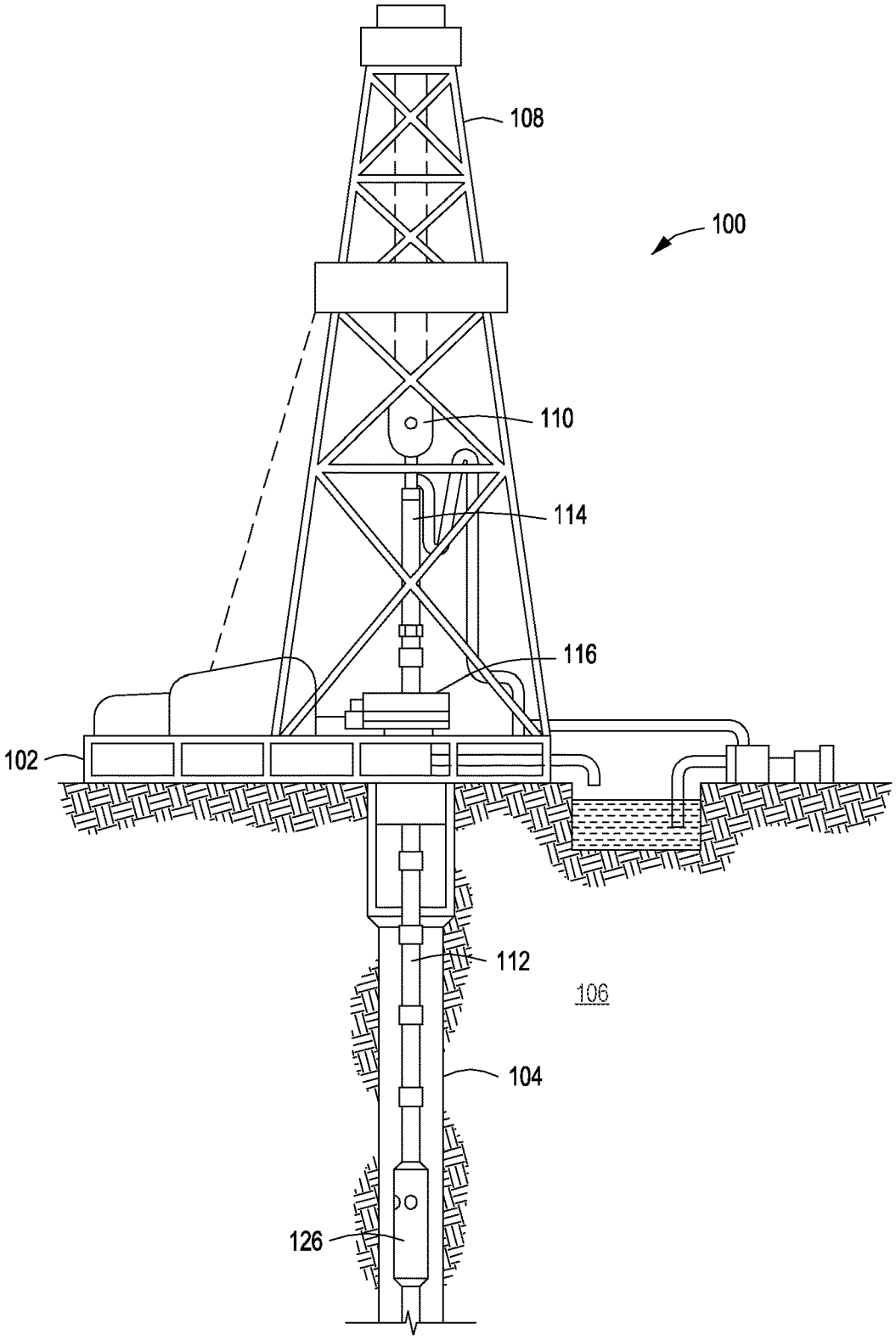
FIG. 1 is a schematic view of an example wellbore system for use in delivering a downhole tool described herein to a downhole location.

The present disclosure relates to subterranean formation operations and, more particularly, to a downhole tool having an axially rotatable valve member.

More specifically, the present disclosure relates to a downhole tool that may have a valve member that is axially rotatable relative to a body having a body inner flow bore between an open position and a closed position of one or more ports in the body. As used herein, the term "a port" or "the port" encompasses a plurality of ports (i.e., two or more ports). The open position permits fluid communication between the port and the body inner flow bore; the closed position prevents fluid communication between the port and the body inner flow bore. The term "in fluid communication" refers to herein as an available flow path between a first location and a second location.

In any of the examples of the downhole tool described herein, the downhole tool comprising the axially rotatable valve member can be used in conjunction (e.g., integrally) with a tubing string (e.g., a production tubing string, a drilling tubing string, and the like), without departing from the scope of the present disclosure. As one example, the downhole tool may be connected at one or both ends to a tubing string. Accordingly, fluid can pass in either the uphole or downhole direction within a wellbore, as described below. An actuable drive shaft of a gearbox and a motor may be connected to the valve member to axially rotate the valve member. To prevent the actuable drive shaft from interfering with the operability or engineering of the downhole tool, it may be located in the body axially offset from the body inner flow bore (e.g., in a protective pocket on the outer diameter of the body). As such, unrestricted fluid flow through the body inner borehole can be achieved (e.g., smooth through bore). Examples of suitable downhole tools include, but are not limited to, a valve, a gas lift valve, an internal control valve, and an auto-fill device.

In an example, the axially rotatable valve member described herein may be a ball, wherein the ball has an inner flow bore and is rotatable by 90° increments between the closed and open positions. That is, the ball rotates in 90° increments where it is fully open or fully closed by each 90° rotation. The direction of rotation is non-limiting, such that the axially rotatable valve member may rotate clockwise or counterclockwise. In an example, the ball may be configured such that the ball is able to rotate to positions between the 90° increments may allow some flow through the inner flow bore, such as for use as a choke (e.g., to create a choked flow), without departing from the scope of the present disclosure. Moreover, the ball axially rotatable valve member may rotate by 90° increments continuously (i.e., with 360° rotation) or in a back-and-forth manner between the closed and open positions, without departing from the scope of the present disclosure. The ball axially rotatable valve member, thus, may be rotated to open or close the port without requiring the ball to travel into a space having wellbore debris (e.g., drill cuttings, treatment fluids, and the like) because the ball rotates within its own space.

In any of the examples described herein, the axially rotatable valve member may be remotely operable (e.g., as a circulation valve). Accordingly, the axially rotatable valve member of the downhole tools described herein may be operated to open or close the port remotely without the need for hydraulic or electrical lines connected to a surface location. As used herein, the term "remotely" means without wellbore intervention (i.e., operation downhole from surface without any direct other than fluid). Alternatively, the downhole tool may be able to be connected via an electric line to the surface, such as attached to the outside of a tubing string.

Not all features of an actual implementation are described or shown in this application for the sake of clarity. It is understood that numerous implementation-specific decisions may need to be made to achieve the developer's goals, such as compliance with system-related, lithology-related, business-related, government-related, and other constraints, which vary by implementation and from time to time. While a developer's efforts might be complex and time-consuming, such efforts would be, nevertheless, a routine undertaking for those of ordinary skill in the art having benefit of this disclosure.

At the very least, and not as an attempt to limit the application of the doctrine of equivalents to the scope of the claim, each numerical parameter herein should at least be construed in light of the number of reported significant digits and by applying ordinary rounding techniques.

While compositions and methods are described herein in terms of "comprising" various components or steps, the compositions and methods can also "consist essentially of" or "consist of" the various components and steps. When "comprising" is used in a claim, it is open-ended.

As used herein, the term "substantially" means largely, but not necessarily wholly.

The use of directional terms such as above, below, upper, lower, upward, downward, left, right, uphole, downhole and the like are used as they are depicted in the figures, and unless otherwise indicated, the upward direction being toward the top of the corresponding figure and the downward direction being toward the bottom of the corresponding figure, the uphole direction being toward the surface of the well and the downhole direction being toward the toe of the well.

FIG. 1 is a schematic diagram of an exemplary wellbore system 100 that may be used for delivering the downhole tools described herein to a downhole location. As illustrated, the wellbore system 100 may include a platform 102 positioned at the Earth's surface and a wellbore 104 that extends from the platform 102 into one or more subterranean formations 106. In alternate examples, such as in an offshore or subsea drilling operation, a volume of water may separate the platform 102 and the wellbore 104.

The wellbore system 100 may include a derrick 108 supported by the platform 102 and having a traveling block 110 for raising and lowering a tubing string 112, such as a drilling tubing string or a production tubing string. As shown, the tubing string 112 may be jointed, however alternatively it may be a continuous tubing string, without departing from the scope of the present disclosure. A kelly 114 may support the tubing string 112 as it is lowered through a rotary table 116. In those instances when the tubing string 112 is a drilling string, a drill bit (not shown) may be coupled to the tubing string 112 and driven by a downhole motor and/or by rotation of the tubing string 112 by the rotary table 116.

As shown, a portion of the tubing string 112 may be fitted with a downhole tool 126, such as the downhole tool comprising the axially rotatable valve member of the present disclosure. As shown, the downhole tool 126 is interspersed between pieces of the tubing string 112 (e.g., jointed tubing), or alternatively placed at one end of the tubing string 112, without departing from the scope of the present disclosure. The axial rotating valve member of the downhole tool 126 thus controls fluid circulation between the interior of the tubing string 112 and the exterior of the tubing string 112 within the annulus between the tubing string 112 and the wellbore 104, which may or may not be cased with casing string (cemented or otherwise). Further, in any example, the wellbore system 100 may further include a bottom hole assembly (BHA) (not shown) coupled to the tubing string 112. The BHA may comprise various downhole measurement tools such as, but not limited to, measurement-while-drilling (MWD) and logging-while-drilling (LWD) tools, which may be configured to take downhole measurements of wellbore conditions. The MWD and LWD tools may be able to deliver one or more downhole tools 126 described herein comprising the axial rotatable valve member(s) to a downhole location. That is, the downhole tool 126 may be connected at one or more ends to an MWD or LWD tool, including one end of an MWD or LWD tool and one end of the tubing string 112, without departing from the scope of the present disclosure.

Figure 2A:
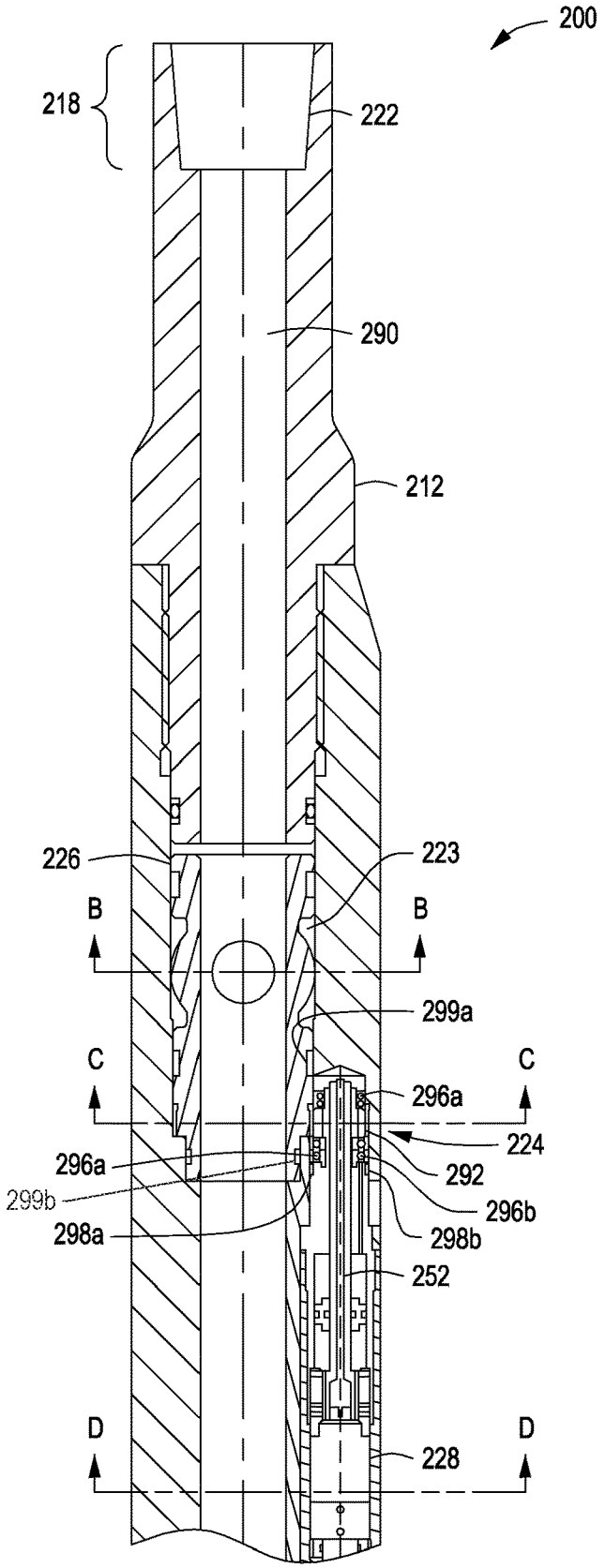
FIGS. 2A-2C are a schematic cross-sectional view of an example downhole tool described herein.
Figure 2B:
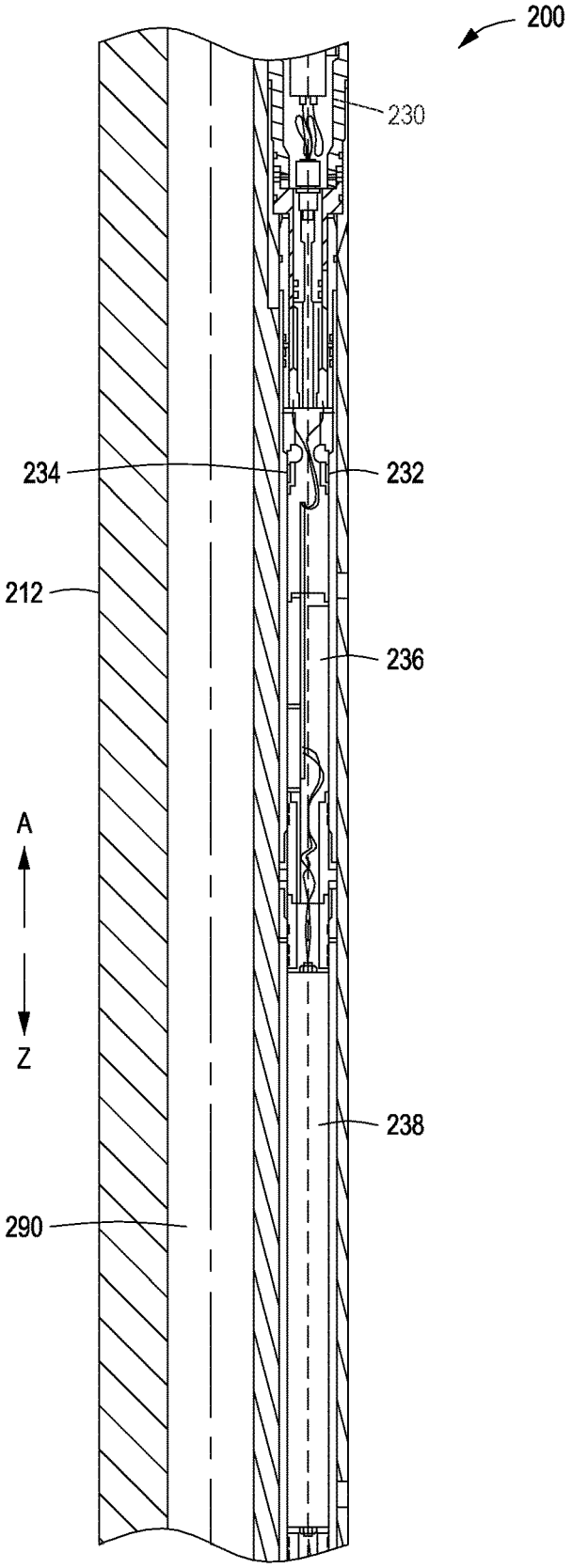
Figure 2C:
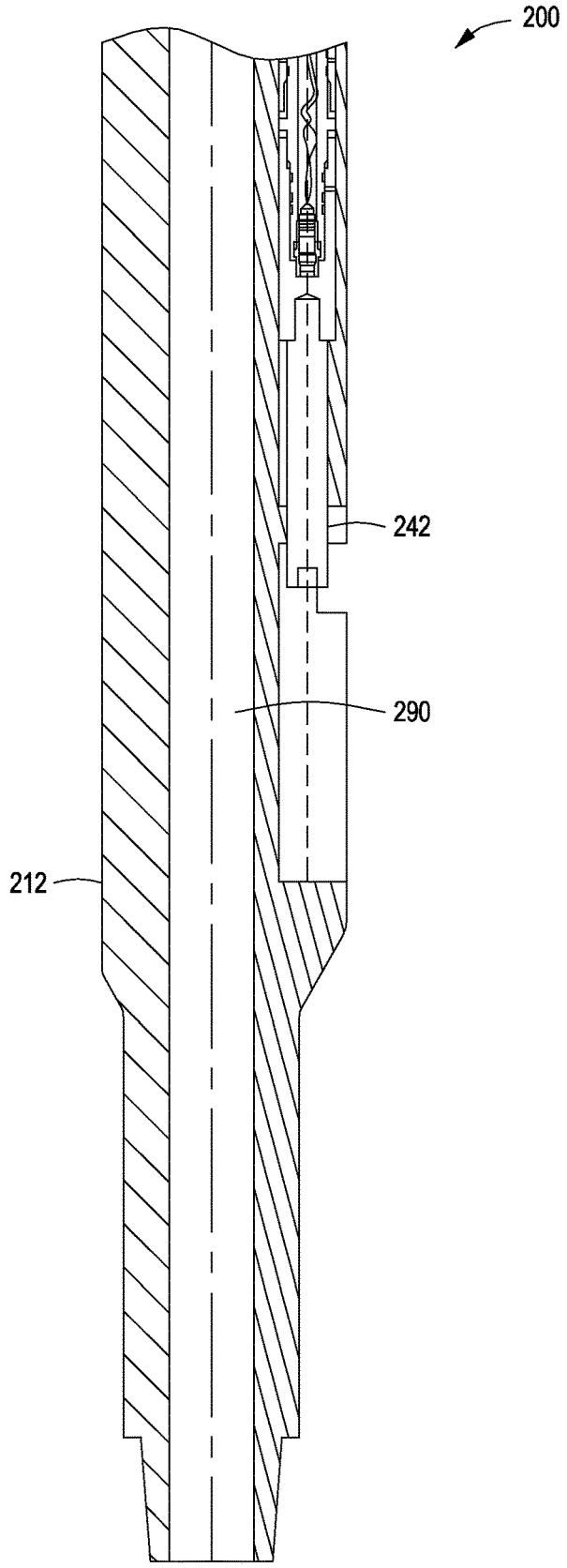

Referring now to FIGS. 2A-2C collectively, illustrated are cross-section of a downhole tool 200, as described according to one or more examples described herein. That is, FIG. 2A represents the upper portion of the downhole tool 200, FIG. 2B represents the middle portion of the downhole tool 200, and FIG. 2C represents the lower portion of the downhole tool 200. The downhole tool 200 may comprise a body 212 having a body inner flow bore 290 and one or more ports 402 (see FIG. 4A). As shown, the body 212 is substantially cylindrical; however, alternatively, the body 212 may be any shape capable of being connected to or with a tubing string 112 (FIG. 1) or otherwise placed in a downhole location to control fluid flow between the interior of a tubing string 112 and an annulus (e.g., the annulus between the exterior of the tubing string 112 and the surface of the wellbore 104 (FIG. 1) or casing string therein.

The body 212 may comprise an upper body portion toward identifier "A" and a lower body portion toward identifier "Z". At a top end 218 of the upper body portion A may be located a connector (not shown) for anchoring the downhole tool 200 in a wellbore, such as a packer, a wireline, or a portion of the tubing string 112 (FIG. 1). Combinations of such anchoring mechanisms may additionally be employed, without departing from the scope of the present disclosure. The top end 218 of the upper body portion A may further define an upper bore portion 222 that connects or otherwise is a continuance of the tubing string 112 (FIG. 1).

As shown, the upper body portion A may house an actuation mechanism 224. The actuation mechanism 224 may include an actual drive shaft 252 of a gearbox 228, and a motor 230, and is described in greater detail below. The actuation mechanism 224 axially rotates a valve member 226 in the inner flow bore 290 to an open or closed position to permit or prevent, respectively, fluid communication between the body inner flow bore 290 and a wellbore (e.g., the wellbore 104 of FIG. 1) through one or more ports 402 (see FIG. 4A). Fluid flow through the body inner flow bore 290 (either downhole or uphole) is not compromised regardless of the position of the valve member 226, although the amount of fluid flow (e.g., fluid rate or volume) may be affected such as when the valve member 226 is in the open position. Debris may enter in an area 223 near the valve member 226, but the valve member 226 merely rotates and is not required to travel through such debris. Additionally, one or more wiper bearing rings 299*a*, 299*b* can be included as part of the valve member 226 to reduce any debris that enters in area 223.

Additionally provided in upper body portion A may be a control system, consisting of pressure transducers 232, 234, a processing module in the form of printed circuit board (PCB) 236 and an inertia sensor, which is preferably part of the PCB. The inertia sensor may be any suitable inertia sensor for downhole use including, but not limited to, those used in the fields of automotive, aeronautical, or medical engineering. A battery 238 may be located the lower body portion Z to provide power to the active components of the control system and the actuating mechanism 224. The downhole tool 200 may optionally include an additional sub-system, which may be a part of the PCB 236 that provides for measurement of additional parameters, such as wellbore temperature.

As shown, the actuation mechanism 224 (and control system and optional sub-system) may be axially offset from the body inner flow bore 290. Accordingly, the actuation mechanism 224 may be mounted to the outer surface of the body 212 (see also FIGS. 3A-3C), such as by a threaded engagement 242 or latching mechanism (see also FIG. 3C), or in some instances may be integral to or surrounded by the body 212 provided that it located beyond (toward to exterior surface of the body 212) the body inner flow bore 290. The mounting may be a cartridge mount, such that a portion of the actuation mechanism 224 (and control system and optional sub-system) slides into a portion of the body 212. The axial offset of the actuation mechanism 224 (and control system and optional sub-system) thus ensures that fluid flow through the body inner flow bore 290 is in no way impeded or slowed by machinery located within the body inner flow bore 290, and regulation of fluid flow is solely achieved by the axial rotation of the valve member 226, which is coupled to and controlled by the actuation mechanism 224.

Figure 5:
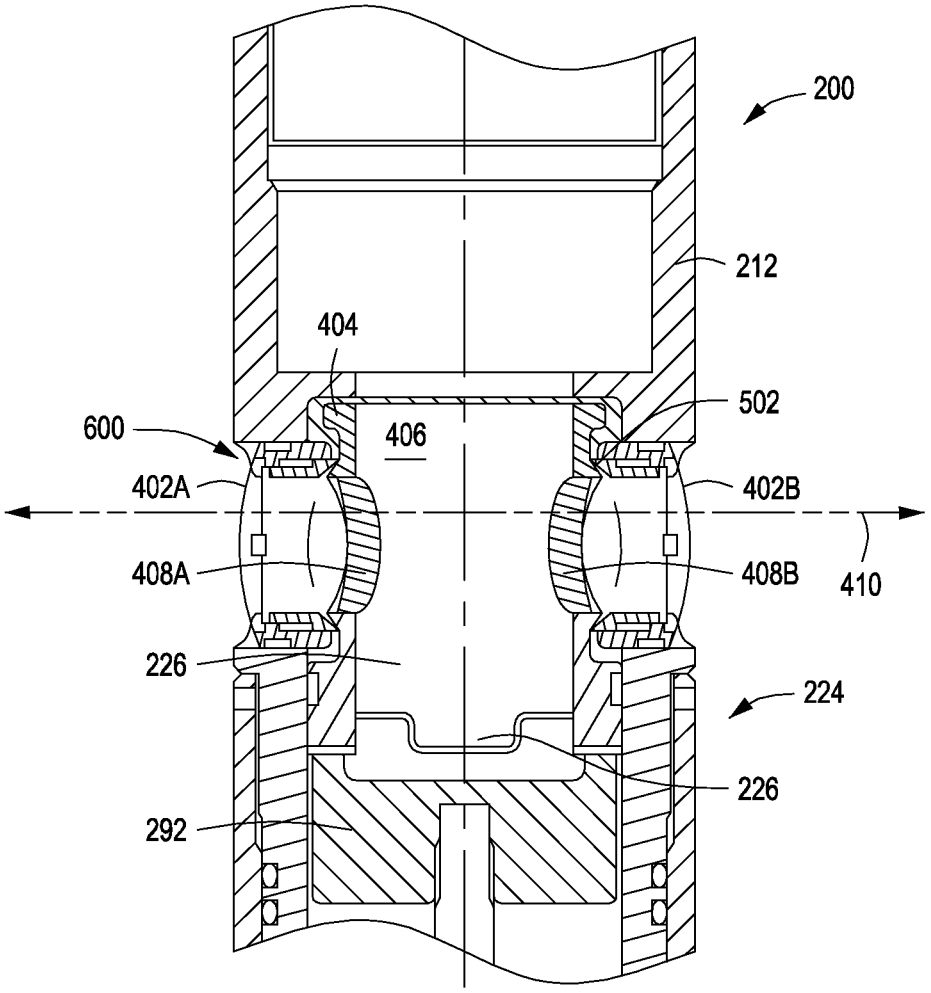
FIG. 5 is a schematic cross-sectional view of an example valve member described herein.

As shown, the gearbox 228 may be a spur gearbox 228 comprising an actuable drive shaft 252 and a spur gear 292. The spur gear 292 may comprise castellations (e.g., gear teeth) that are complementary to and in contact with castellations 294 (e.g., gear teeth) on the valve member 226, such that rotation of the drive shaft 252 rotates the spur gear 292, which in turn rotates the valve member 226. The drive shaft 252 may be operable by actuation of the motor 230, such that when the motor 252 is actuated, rotation of the drive shaft 252 via the gearbox 228 occurs. Reverse rotation of the drive shaft 252 may be effectuated by reverse rotation of the motor or selection of a reverse gear. As previously stated, and as discussed in greater detail below, the rotation of the valve member 226 may be in 90° increments, and thus the rotation of the drive shaft 252 by the motor 230 may be in 90° increments. The gearbox 228 may further comprise bearings 296*a*, 296*b*, and one or more seals 298*a*, 298*b* (two shown) for sealing internal and external pressure differentials. The seals 298A, 298B isolate fluid communication from the wellbore 104 (FIG. 1) and the body inner flow bore 290 to allow meshing of the actuation mechanism 224 to the valve member 226, as the actuation mechanism is mounted offset from the body inner flow bore 290, as described herein. The seals 298A, 298B may be necessary to isolate fluid communication between the wellbore 104 (FIG. 1) and the inner flow bore 290 due to the machined breakthrough needed to allow coupling of the valve member 226 castellations 294 and the castellations 506 on a spur gear 292 (FIG. 5).

Figure 3A:
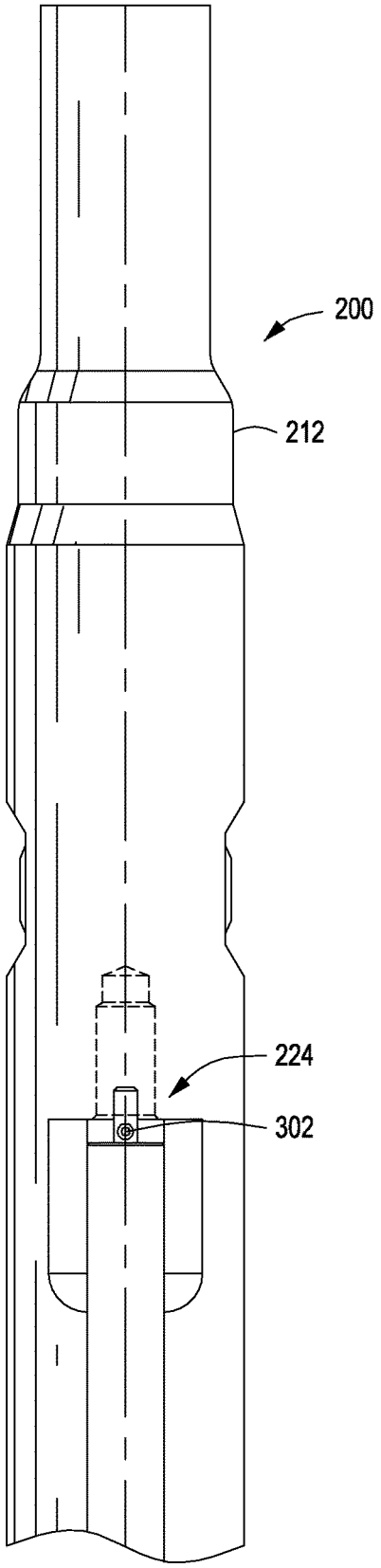
FIGS. 3A-3C are a schematic top-view of an example downhole tool described herein.
Figure 3B:
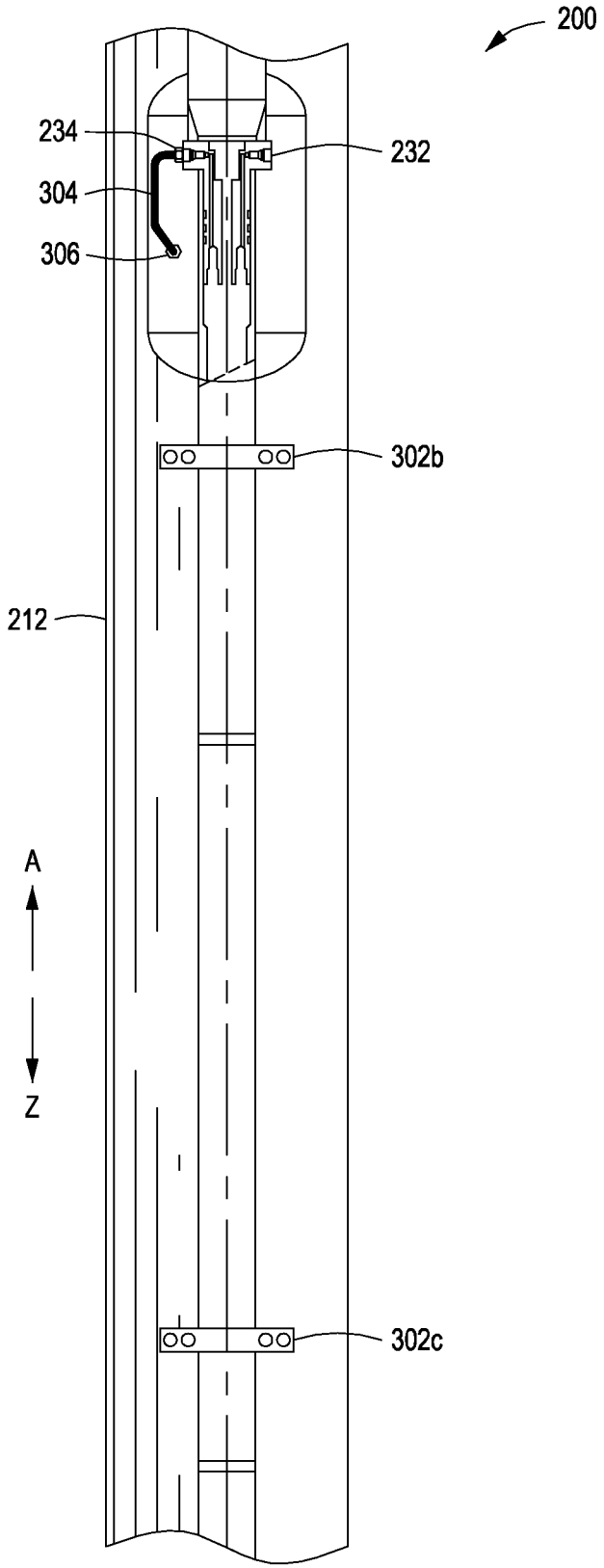
Figure 3C:
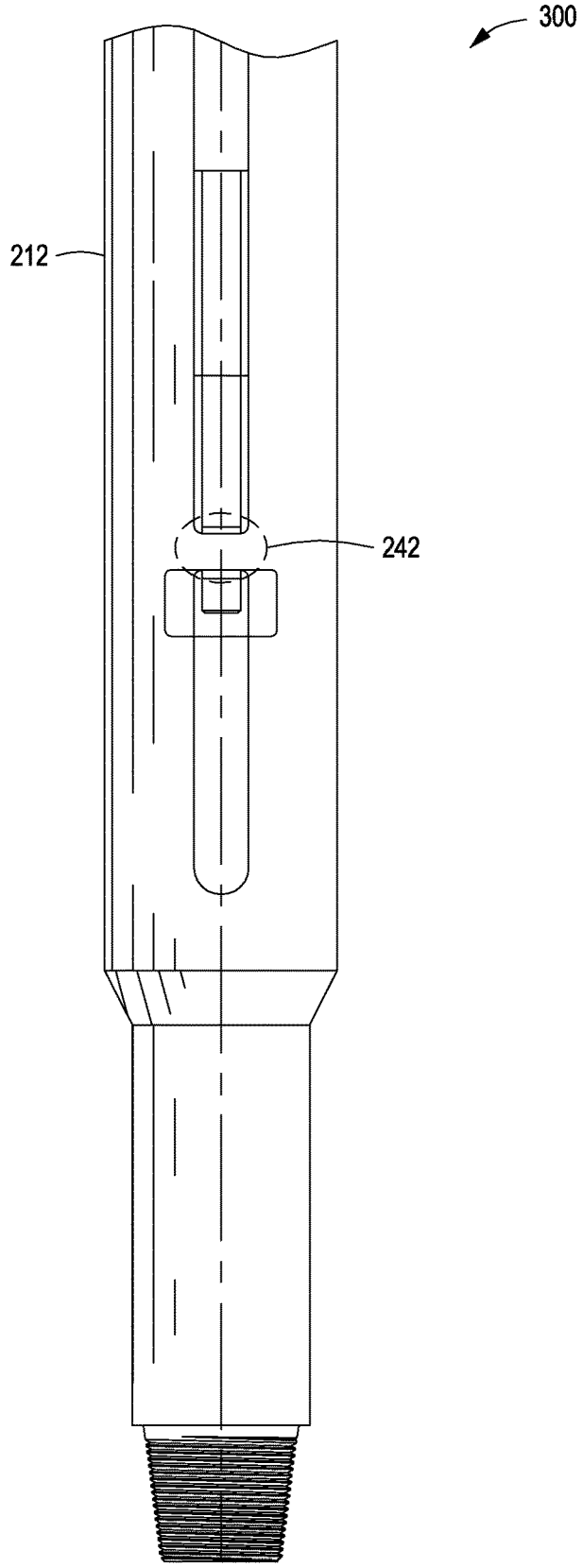

Referring now to FIG. 3A-3C collectively, with continued reference to FIGS. 2A-2C collectively, illustrated is a top-view of a downhole tool 200, as described according to one or more examples described herein (e.g., comprising or capable of comprising an axially rotatable valve member as described above). That is, FIG. 3A represents the upper portion of the downhole tool 200, FIG. 3B represents the middle portion of the downhole tool 200, and FIG. 3C represents the lower portion of the downhole tool 200. As shown, the actuation mechanism 224 (and control system and optional sub-system) may be mounted to the outside surface of the body 212 of the downhole tool 200. The actuation mechanism 224 (and control system and optional sub-system) may be mounted using one or more latching mechanisms 302*a*, 302*b*, 302*c* (e.g., screws, bolts, solder, and the like). The actuation mechanism 224 (and control system and optional sub-system) may additionally have a threaded engagement 242 which threads (e.g., screws) to a lower body portion Z of the body 212. Other mounting mechanisms may additionally be employed without departing from the scope of the present disclosure, provided that they are suitable for use in a downhole environment.

As described above, the control system of the downhole tool 200 may include pressure transducers 232, 234. The pressure transducers 232, 234 may be used to measure the hydrostatic pressure. For example, pressure transducer 232 may measure pressure in the annulus of the wellbore 104 (FIG. 1). That is, pressure transducer 232 may measure pressure that is external to the downhole tool 200. Differently, pressure transducer 234 may measure pressure that is internal to the downhole tool 200, such as within the body inner flow bore 290 (FIGS. 2A-2C). Connected to pressure transducer 234 may be a pressure sensing line 304 extending into the body inner flow bore 290 (FIGS. 2A-2C) through a sensing line port 306. The pressure transducers 232, 234 may be used to toggle the valve member 226 (FIG. 2A) from the open and closed position, as described in greater detail below.

Figure 4A:
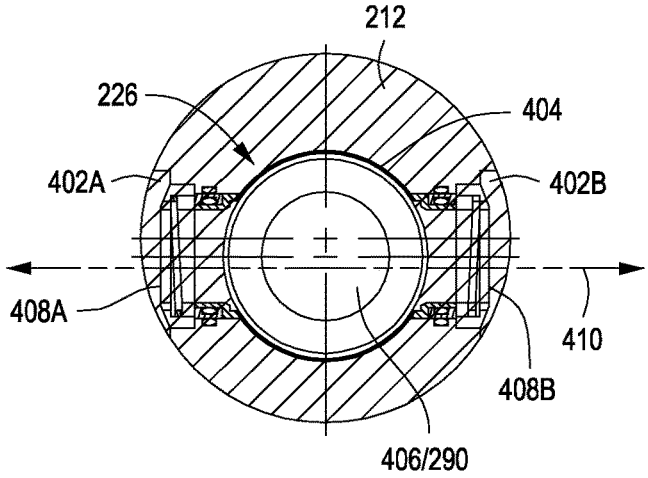
FIGS. 4A-4C are schematic cross-sectional views of an example downhole tool described herein.

Referring now to FIG. 4A, with continued reference to FIGS. 2A-2C, illustrated is a cross-sectional view of the downhole tool 200 of FIGS. 2A-2C at cross-sectional designation B-B (FIG. 2A). As shown, the body 212 may be provided with two radial ports 402A, 402B, through which fluid can flow into the annulus between the downhole tool 200 (FIGS. 2A-2C) and the wellbore 104 (FIG. 1) when the valve member 226 is in its open position. As shown, the valve member 226 may be a single piece-part that has a generally cylindrical body 404, and may be provided with a ball inner flow bore 406, which is a continuation of the body inner flow bore 290. Two diametrically opposed apertures 408A, 408B may be provided as integral to the valve member 226 so as to form ball radial flow bore 410.

As described above, the valve member 226 may rotate in 90° increments within the body 212 to either align or misalign the apertures 408A, 408B with the ports 402A, 402B. Accordingly, the valve member 226 may rotate back and forth by 90° within the body, 180° within the body, or 360° within the body, without departing from the scope of the present disclosure. When the apertures 408A, 408B are aligned with the ports 402A, 402B when the valve member 226 is in its open position to permit fluid flow through the ball radial flow bore 410. In the open position, fluid flow may be bidirectional between the annulus and the ball radial flow bore 410 (and the ball inner flow bore 406 and body inner flow bore 290). When the apertures 408A, 408B are misaligned with the ports 402A, 402B when the valve member 226 is in its closed position to prevent fluid flow through the ball radial flow bore 410. Accordingly, in the closed position, fluid flow is prevented bidirectionally from entering or exiting the ball radial flow bore 410. The valve member 226 is discussed in greater detail below in FIGS. 5 and 6.

Figure 4B:
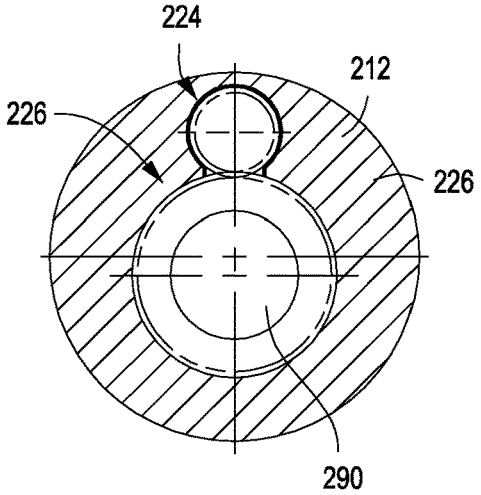
Figure 4C:
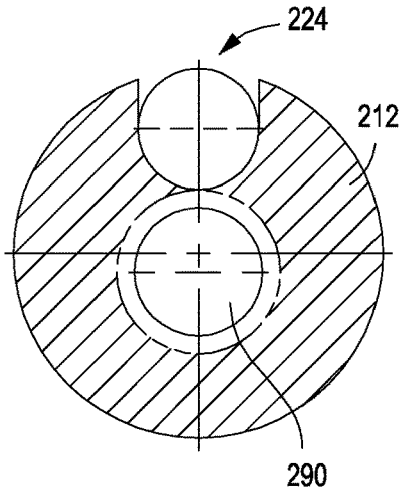

Referring now to FIG. 4B, with continued reference to FIGS. 2A-2C, illustrated is a cross-sectional view of the downhole tool 200 of FIGS. 2A-2C at cross-sectional designation C-C (FIG. 2A). As shown, the body inner flow bore 290 is open and a bottom portion of the valve member 226 is provided within the body inner flow bore 290. The actuation mechanism 224 appears above and outside of the body inner flow bore 290, but is embedded or otherwise cartridge mounted in the body 212. That is, the body 212 extends about the outside surface of the actuation mechanism 224, as shown. Referring now to FIG. 4C, with continued reference to FIGS. 2A-2C, illustrated is a cross-sectional view of the downhole tool 200 of FIGS. 2A-2C at cross-sectional designation D-D (FIG. 2A). As shown, the body inner flow bore 290 is open and the valve member 226 is no longer within the body inner flow bore 290. The actuation mechanism 224 appears above and outside of the body inner flow bore 290, and outside of the body 212. That is, the actuation mechanism 224 is mounted outside of the exterior of the body 212, as shown.

Referring now to FIG. 5, with continued reference to FIGS. 2A-2C, illustrated is a cross-sectional detailed view of the valve member 226 and a portion of the actuation mechanism 224 of a downhole tool 200. As discussed with reference to FIG. 4A, the valve member 226 may have a generally cylindrical body 404, a ball inner flow bore 406, and a ball radial flow bore 410, and two diametrically opposed apertures 408A, 408B. The valve member 226 may further include a part-spherical formation 502 upstanding from the body 404 through which the apertures 408A, 408B extend. The apertures 408A, 408B align or misalign with the ports 402A, 402B based on the 90° rotation of the valve member 226. The part-spherical formation 502 may provide a spherical surface on which a seal arrangement, generally shown at 600, seals around the apertures 408A, 408B. As shown, the valve member 226 may comprise castellations 294 that are complementary with castellations 506 on a spur gear 292 (part of the gearbox 228).

Figure 6:
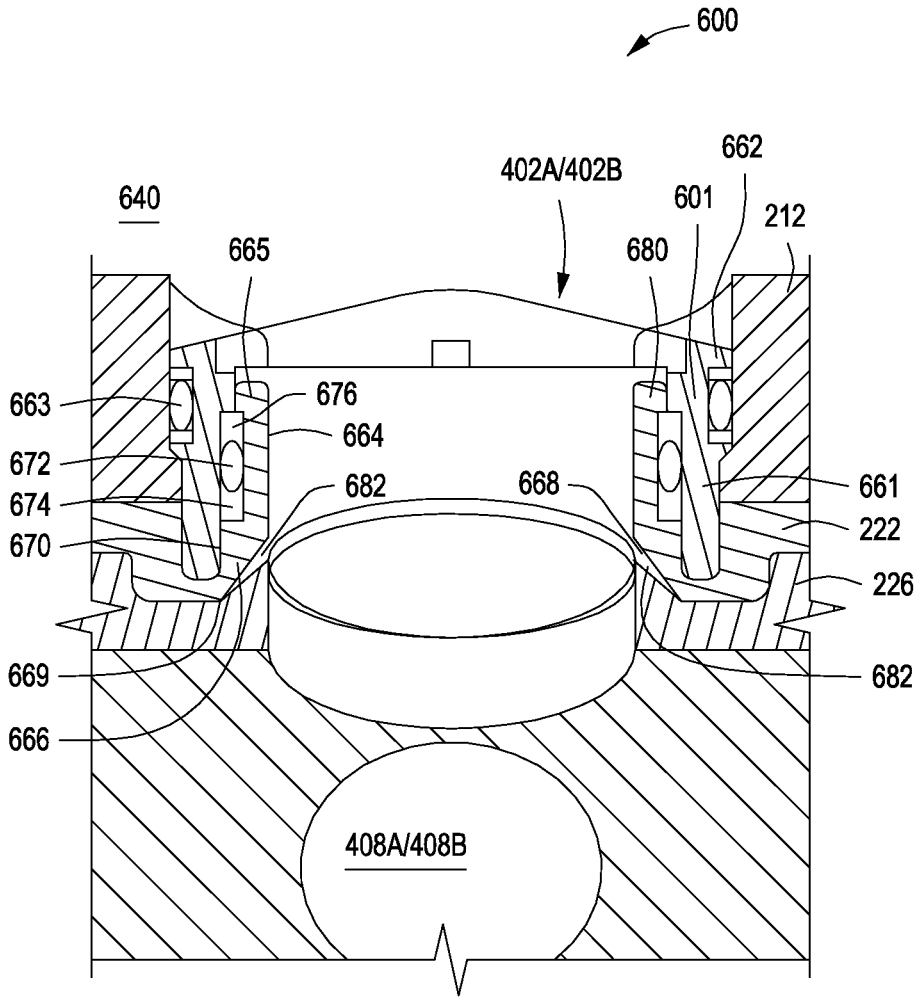
FIG. 6 is a schematic cross-sectional view of an example seal arrangement of a valve member described herein.

Referring now to FIG. 6, with continued reference to FIG. 5, illustrated is a cross-sectional detailed view of the sealing arrangement 600. The sealing arrangement 600 may include an annular retaining ring 601 located in a port 402A/402B (FIG. 4A) in the body 212 (FIGS. 2A-2C). The annular retaining ring 601 may be fixed to the body 212 and surround the port 402A/402B. The annular retaining ring 601 may include an inner cylindrical portion 661 and an outer collar portion 662. A seal 663 may be provided between the annular retaining ring 601 and the body 212 to prevent fluid flow therethrough.

The annular retaining ring 601 may be used to retain the valve seat 664, the outer cylindrical portion 665, the elastically deformable seal 672, the annular space 670, and the seal 663, where the outer cylindrical portion 665, the elastically deformable seal 672, and the annular space 670 are described below. The valve seat 664 may be substantially annular in shape and disposed about the port 402A/402B. The valve seat 664 may be composed of a metal and define a lower surface 668 that is complementary to a surface of the valve member 226, which may also be composed of a metal, thus forming a metal-to-metal seal. Such a metal-to-metal seal may become tighter and more resilient with the greater differential pressure between the wellbore 102 (FIG. 1) and the annulus. The valve seat 664 may additionally have an outer cylindrical portion 665 and an inner collar portion 666.

The annular retaining ring 601 and the valve seat 664 may define an annular space 670 between the respective faces of the collar portions 662, 666 and the sidewalls. Disposed within the annular space 670 may be an elastically deformable seal 672 having inner back up ring 674 and outer back up ring 676. The elastically deformable seal 672 and the back up rings 674, 676 together may substantially fill the annular space 670. The elastically deformable seal 672 may be made of any elastomeric material suitable for forming a seal in a downhole environment, including relatively hard plastic material such as polytetrafluoroethylene. The dimensions of the elastically deformable seal 672 and back up rings 674, 676 may be selected to take up any manufacturing tolerances to ensure contact of the valve seat 664 with the valve member 226 and the circular seal ring 669.

The sealing arrangement 600 provides a double piston effect metal-to-metal seal. In other words, the seal functions regardless of direction of the pressure differential across the seal. When the pressure in the upper bore portion 222 is greater than that in the region 640, wellbore fluid enters the annular space 670 beneath the elastically deformable seal 672 through the gap between the annular retaining ring 601 and the valve seat 664. The high pressure forces the elastically deformable seal 672 and inner back up ring 674 upwards, and also acts on an inner bearing surface defined by the inner collar portion 666. This forces the valve seat 664 into sealing contact with the valve member 226.

When the pressure in the region 640 is greater than that in the upper bore portion 222, wellbore fluid will act on the outer surface 680 of the outer cylindrical portion 665 of the valve seat 664. Wellbore fluid also enters the annular space 670 above the elastically deformable seal 672 through the upper gap between the annular retaining ring 601 and the valve seat 664. The high pressure forces the elastically deformable seal 672 downwards, into contact with the inner backup ring 674, which in turn acts on the inner bearing surface defined by the inner collar portion 666 of the seat. The resultant downward force on the outer surface 680 and the inner bearing surface defined by the inner collar portion 666 is greater than the upward force on the smaller area 682 of the lower surface 668. The net force is therefore downward, forcing the valve seat 664 into sealing contact with the valve member 226.

Referring back to FIGS. 2B and 4B, the valve member 226 may be run into a wellbore in either its closed or open position, without departing from the scope of the present disclosure. Actuation (either to the closed or open position) of the valve member 226 results when an actuation signal is sent to the motor 230 to cause the valve member 226 to be rotated from one position to another. That is, the apertures 408A, 408B are moved from one position to another to either form the ball radial flow path 410 in the open position or de-form the ball radial flow path 410 in the closed position.

A variety of techniques may be used to actuate closing or opening of the valve member 226. As an example, the downhole tool 200 may be introduced downhole (e.g., into a wellbore 104 (FIG. 1), and the control system (described above) configured to monitor the hydrostatic pressure by one or both of the pressure transducers 232, 234. In any example, the movement of the apparatus via an inertia sensor may be monitored, without departing from the scope of the present disclosure.

Such remote actuation methods do not rely on surface communication, such as a conductor, to provide an initiation signal, thus eliminating or reducing lengthy time delays to allow for running and retrieval of communication lines during installation.

The actuation signal may be based purely on a timer signal or a hydrostatic pressure measurement, or pressure increase downhole caused by pressure application at surface.

The actuation signal may be based on reaching (or exceeding or falling below) a reference pressure value by monitoring pressure characteristics in the wellbore with the pressure transducer 232, or the tubing string with the pressure transducer 234. As an example, the pressure above the downhole tool 200 is increased from the surface of a wellbore, and an applied pressure value using measurements obtained from the pressure transducer 234 and the reference pressure value may be calculated. When this calculated applied pressure falls within the predetermined range for a specified time, a pressure equalizing signal may be generated, which actuates the motor to rotate the valve member 226 90° to either the closed or open position.

In such a manner, the pressure reference point may be used as reference for the conditions at which the pressure signal is generated for actuation of the valve member 226. When the pressure at the surface of the wellbore is increased by a specified amount (falling within the "opening window"), for example, the calculated applied pressure will correspond to the pressure applied at surface (i.e., the pressure applied at surface does not need to be adjusted to take account of variations in wellbore pressure downhole).

As described above, the downhole tool 200 may be run into a wellbore on a tubing string for remote operation (or in alternative examples, on an electric line), which may desirably be run with the valve member 226 in an open configuration, such as to ease setting the downhole tool 200 in the desired downhole location.

In an example, the control system is located below the motor 230; alternatively, the control system is located above the motor. When the control system is located below the motor 230, a first piston may be arranged around the drive shaft 252 such that its upper surface is acted upon by pressure in the inner flow bore 290 (i.e., pressure in the tubing string, when the valve member 226 is in the closed position, and the pressure through the ports 402A, 402B, when the valve member 226 is in the open position). A lower side of the piston may act on a sealed oil chamber arranged around the motor 230 and gearbox 228. The chamber may end at an upwardly directed face including a pressure transducer, which effectively measure the pressure in the inner flow bore 290. A second pressure transducer may be located at the end of the chamber, where it is directed to an outer surface of the downhole tool 200 to determine the pressure in the annulus.

In some uses, once the downhole tool 200 has been set in a wellbore 104 (FIG. 1), it may periodically sample the pressure. When the control system detects a slow change in pressure, it may consider this a change in hydrostatic pressure and continues to self-zero. When the control system detects a faster change in pressure, it may use this as an indication that pressure is being applied at the surface. Pressure history may be used to determine the current hydrostatic pressure. The downhole tool 200 then monitors the pressure that is applied at surface. If the pressure applied at surface remains within a pre-determined window for a pre-determined length of time this may be considered an actuation signal command. The actuation signal is then sent to the motor 230 and gearbox 228 to rotate the valve member 226 to an open or closed position.

Testing may be performed at pressures above and below the opening window without the valve opening. The downhole tool 200 may, in some examples, only respond to an opening command (or closing command) on pressure up. If the pressure exceeds the opening window and then goes down into the opening window, the control system will not respond. The control system may begin to start self-zeroing again once it has determined that a pressure test has ended (i.e., when there is no longer pressure being applied at surface).

A data download port through which historical data on pressure, temperature and other variables may also be included in the downhole tool 200, where the historical data may be downloaded when the downhole tool 200 is retrieved surface, or may be electrically sent (e.g., via a wireline) to surface. Alternatively or additionally, data (historical or real time) may be set to the surface via an electronic signal (as previously described), an acoustic signal, a pressure signal, and the like, and any combination thereof. It is to be appreciated that the operation of the downhole tool 200 is not dependent on sending pressure and/or temperature data to the surface. Indeed no surface control is required to operate the downhole tool 200, thereby removing the requirement for connections between the surface and downhole, although such connections may be made if desirable, without departing from the scope of the present disclosure.

The structure of the valve member 226 and associated sealing arrangement 600 (FIG. 6) (e.g., its metal-to-metal seal) permits the downhole tool 200 to be run into a wellbore 104 (FIG. 1) in its open position, without compromising seal integrity. This may allow fluid to fill a tubing string during running in, or may allow circulation of high density fluid in a well kill application. The actuation signal described herein further permits closing the valve member 226 when pressure integrity is required, for example. The downhole tool 200 may further be closed, opened, re-closed, and re-opened as many times as necessary in a downhole environment, with little or no damage to the seal. Additionally, the actuation signal mechanisms can be achieved by applying a certain pressure at surface over a certain length of time, and it may be designed to compensate for hydrostatic pressure to allow such surface pressure detection. The use of a timer, inertia sensor, or hydrostatic pressure signal to initiate the closing or opening of the valve has particular application to downhole tools and apparatus for which actuation by controlled application of pressure from the surface may not be suitable, or completion strings having other components initiated by application of pressure cycles.

While various examples have been shown and described herein, modifications may be made by one skilled in the art without departing from the scope of the present disclosure. The examples described here are exemplary only, and are not intended to be limiting. Many variations, combinations, and modifications of the examples disclosed herein are possible and are within the scope of the disclosure. Moreover, the examples depicted are not necessarily drawn to scale. Accordingly, the scope of protection is not limited by the description set out above, but is defined by the claims which follow, that scope including all equivalents of the subject matter of the claims.

Examples disclosed herein include:

Example A: A downhole tool comprising: a body having a body inner flow bore; a port in the body; a valve member axially rotatable relative to the body between an open position and a closed position, wherein the open position allows fluid communication between the port and the body inner flow bore and the closed position prevents fluid communication between the port and the body inner flow bore; and an actuable drive shaft of a gearbox and a motor connected to the valve member to axially rotate the valve member, wherein the gearbox and the motor are in the body and axially offset from the body inner flow bore.

Example A may have one or more of the following additional elements in any combination:

Element A1: Wherein the drive shaft is remotely actuable to axially rotate the valve member.

Element A2: Wherein the valve member is a ball having a ball inner flow bore and a ball radial flow bore.

Element A3: Wherein the valve member is a ball having a ball inner flow bore and a ball radial flow bore, and the drive shaft rotates the ball by 90° increments to the open position and the closed position.

Element A4: Wherein the gearbox is a spur gearbox.

Element A5: Wherein the downhole tool is a section of a downhole tubing string, and wherein the open position allows fluid communication between an interior of the tubing string and an exterior of the tubing string.

Element A6: Wherein the downhole tool is a valve, a gas lift valve, an internal control valve, or an auto-fill device.

By way of non-limiting example, exemplary combinations applicable to A include: A1-A6; A2, A4, and A6; A1 and A5; A1, A3, and A4; A4 and A6; A4 and A5; A2, A5, and A6; A1 and A3; and the like.

Example B: A method comprising: introducing a downhole tool including a body having a body inner flow bore and a port into a wellbore in a subterranean formation; and axially rotating a valve member relative to the body between an open position and a closed position with an actuable drive shaft of a gearbox and a motor connected to the valve member, wherein the open position allows fluid communication between the port and the body inner flow bore and the closed position prevents fluid communication between the port and the body inner flow bore, and wherein the gearbox and the motor are in the body and axially offset from the body inner flow bore.

Example B may have one or more of the following additional elements in any combination:

Element B1: Further comprising remotely actuating the drive shaft to axially rotate the valve member.

Element B2: Wherein the valve member is a ball having a ball inner flow bore and a ball radial flow bore.

Element B3: Wherein the valve member is a ball having a ball inner flow bore and a ball radial flow bore, and further comprising axially rotating the ball by 90° increments to the open position and the closed position.

Element B4: Further comprising connecting the downhole tool to a tubing string in the wellbore, such that the open position allows fluid communication between an interior of the tubing string and an exterior of the tubing string.

Element B5: Wherein the gearbox is a spur gearbox.

Element B6: Wherein the downhole tool is a valve, a gas lift valve, an internal control valve, or an auto-fill device.

By way of non-limiting example, exemplary combinations applicable to B include: B1-B7; B2, B4, and B6; B1 and B3; B1, B4, and B5; B3 and B6; B2, B3, B4, and B6; B1 and B2; and the like.

Example C: A system comprising: a wellbore in a subterranean formation; a downhole tool disposed in the wellbore, the downhole tool comprising: a body having an inner flow bore; a port in the body; a valve member axially rotatable relative to the body between an open position and a closed position, wherein the open position allows fluid communication between the port and the body inner flow bore and the closed position prevents fluid communication between the port and the body inner flow bore; and an actuable drive shaft of a gearbox and a motor connected to the valve member to axially rotate the valve member, wherein the gearbox and the motor are in the body and axially offset from the body inner flow bore.

Example C may have one or more of the following additional elements in any combination:

Element C1: Wherein the drive shaft is remotely actuable to axially rotate the valve member.

Element C2: Wherein the valve member is a ball having a ball inner flow bore and a ball radial flow bore.

Element C3: Wherein the valve member is a ball having a ball inner flow bore and a ball radial flow bore, and the drive shaft rotates the ball by 90° increments to the open position and the closed position.

Element C4: Wherein the gearbox is a spur gearbox.

Element C5: Wherein the downhole tool is a section of a downhole tubing string, and wherein the open position allows fluid communication between an interior of the tubing string and an exterior of the tubing string.

Element C6: Wherein the downhole tool is a valve, a gas lift valve, an internal control valve, or an auto-fill device.

By way of non-limiting example, exemplary combinations applicable to C include: C1-C6; C2, C3, and C6; C2 and C5; C4, C5, and C6; C3 and C4; C1 and C2; C3 and C6; and the like.

Therefore, the present disclosure is able to attain the ends and advantages mentioned as well as those that are inherent therein. The particular Examples disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative Examples disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from a to b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A downhole tool comprising:

a body having a body inner flow bore;

a port in the body;

a valve member configured to rotate around the longitudinal axis of the body between an open position and a closed position, wherein the open position allows fluid communication between the port and the body inner flow bore and the closed position prevents fluid communication between the port and the body inner flow bore, and wherein the open position and closed position allow for fluid communication within the body inner flow bore along the longitudinal axis; and an actuable drive shaft of a gearbox and a motor connected to the valve member to rotate the valve member around the longitudinal axis of the body, wherein the gearbox and the motor are in the body and axially offset from the body inner flow bore.

2. The downhole tool of claim 1, wherein the drive shaft is remotely actuable to rotate the valve member around the longitudinal axis of the body.

3. The downhole tool of claim 1, wherein the valve member is a ball having a ball inner flow bore and a ball radial flow bore.

4. The downhole tool of claim 1, wherein the valve member is a ball having a ball inner flow bore and a ball radial flow bore, and the drive shaft rotates the ball by 90° increments to the open position and the closed position.

5. The downhole tool of claim 1, wherein the gearbox is a spur gearbox.

6. The downhole tool of claim 1, wherein the downhole tool is a section of a downhole tubing string, and wherein the open position allows fluid communication between an interior of the tubing string and an exterior of the tubing string.

7. The downhole tool of claim 1, wherein the downhole tool is a valve, a gas lift valve, an internal control valve, or an auto-fill device.

8. A method comprising:

introducing a downhole tool including a body having a body inner flow bore and a port into a wellbore in a subterranean formation; and rotating a valve member around the longitudinal axis of the body between an open position and a closed position with an actuable drive shaft of a gearbox and a motor connected to the valve member, wherein the open position allows fluid communication between the port and the body inner flow bore and the closed position prevents fluid communication between the port and the body inner flow bore, wherein the open position and closed position allow for fluid communication within the body inner flow bore along the longitudinal axis, and wherein the gearbox and the motor are in the body and axially offset from the body inner flow bore.

9. The method of claim 8, further comprising remotely actuating the drive shaft to rotate the valve member around the longitudinal axis.

10. The method of claim 8, wherein the valve member is a ball having a ball inner flow bore and a ball radial flow bore, and further comprising axially rotating the ball by 90° increments to the open position and the closed position.

11. The method of claim 8, further comprising connecting the downhole tool to a tubing string in the wellbore, such that the open position allows fluid communication between an interior of the tubing string and an exterior of the tubing string.

12. The method of claim 8, wherein the gearbox is a spur gearbox.

13. The system of claim 8, wherein the downhole tool is a valve, a gas lift valve, an internal control valve, or an auto-fill device.

14. A system comprising:

a wellbore in a subterranean formation;

a downhole tool disposed in the wellbore, the downhole tool comprising:

a body having an inner flow bore;

a port in the body;

a valve member configured to rotate around the longitudinal axis of the body between an open position and a closed position, wherein the open position allows fluid communication between the port and the body inner flow bore and the closed position prevents fluid communication between the port and the body inner flow bore and wherein the open position and closed position allow for fluid communication within the body inner flow bore along the longitudinal axis; and an actuable drive shaft of a gearbox and a motor connected to the valve member to rotate the valve member around the longitudinal axis of the body, wherein the gearbox and the motor are in the body and axially offset from the body inner flow bore.

15. The system of claim 14, wherein the drive shaft is remotely actuable to rotate the valve member around the longitudinal axis of the body.

16. The system of claim 14, wherein the valve member is a ball having a ball inner flow bore and a ball radial flow bore.

17. The system of claim 14, wherein the valve member is a ball having a ball inner flow bore and a ball radial flow bore, and the drive shaft rotates the ball by 90° increments to the open position and the closed position.

18. The system of claim 14, wherein the gearbox is a spur gearbox.

19. The system of claim 14, wherein the downhole tool is a section of a downhole tubing string, and wherein the open position allows fluid communication between an interior of the tubing string and an exterior of the tubing string.

20. The system of claim 14, wherein the downhole tool is a valve, a gas lift valve, an internal control valve, or an auto-fill device.

* * * * *